US006755726B2

(12) United States Patent
Chen et al.

(10) Patent No.: US 6,755,726 B2
(45) Date of Patent: Jun. 29, 2004

(54) POLISHING HEAD WITH A FLOATING KNIFE-EDGE

(75) Inventors: Tzu-Shin Chen, Tai-nan (TW); Ming-Hsing Kao, Yang-Kang (TW); Chin-Kun Lin, Kaohsiung (TW); Wen-Chin Lin, Kaohsiung Hsien (TW)

(73) Assignee: United Microelectric Corp., Hsin-Chu (TW)

( * ) Notice: Subject to any disclaimer, the term of this patent is extended or adjusted under 35 U.S.C. 154(b) by 0 days.

(21) Appl. No.: 10/063,127

(22) Filed: Mar. 25, 2002

(65) Prior Publication Data

US 2003/0181153 A1 Sep. 25, 2003

(51) Int. Cl.[7] ..... B24B 5/00
(52) U.S. Cl. ..... 451/398; 451/288; 451/289
(58) Field of Search ..... 451/398, 285–289, 451/388, 460, 41, 59, 63

(56) References Cited

U.S. PATENT DOCUMENTS 6,146,259 A * 11/2000 Zuniga et al. ..... 451/398
6,159,079 A * 12/2000 Zuniga et al. ..... 451/41
6,277,014 B1 * 8/2001 Chen et al. ..... 451/398
6,361,419 B1 * 3/2002 Zuniga et al. ..... 451/287
6,375,549 B1 * 4/2002 Glashauser et al. ..... 451/41
6,390,905 B1 * 5/2002 Korovin et al. ..... 451/286
6,431,968 B1 * 8/2002 Chen et al. ..... 451/398

* cited by examiner

*Primary Examiner*—Hadi Shakeri
(74) *Attorney, Agent, or Firm*—Winston Hsu

(57) ABSTRACT

A polishing head with a floating knife-edge mechanism includes a base, a retaining ring secured to the base defining a pocket area beneath the base, and a lower assembly floating within the pocket area via a diaphragm seal. The lower assembly includes a disk-shaped support plate having a plurality of apertures distributed in a center region of the support plate, a clamp ring used to secure the diaphragm seal along a rim region of the support plate, and the floating knife-edge mechanism positioned between the rim region and the center region of the support plate.

11 Claims, 3 Drawing Sheets

POLISHING HEAD WITH A FLOATING KNIFE-EDGE

BACKGROUND OF INVENTION

1. Field of the Invention

The present invention relates generally to the field of chemical mechanical polishing of wafers, and more particularly to an improved polishing head with a floating knife-edge.

2. Description of the Prior Art

In the process of fabricating integrated circuits, it is essential to form multi-level material layers and structures on a wafer or die. However, the prior formations often leave the top surface topography of an in-process wafer highly irregular. Such irregularities cause problems when forming the next layer over a previously-formed integrated circuit structure. For example, when printing a photolithographic pattern having small geometries over previously-formed layers, a very shallow depth of focus is required. Therefore, there is a need to periodically planarize the wafer surface.

One technique for planarizing the surface of a wafer is chemical mechanical polishing (CMP). In CMP processing, a wafer is placed face down on a rotating platen. The wafer, held in place by a carrier or polishing head, independently rotates about its own axis on the platen. Typically, the head is a floating polishing head with a flexible membrane. On the surface of the platen is a polishing pad over which there is dispensed a layer of polishing slurry. The slurry chemistry is essential to proper polishing. Typically, it consists of a colloidal solution of silica particles in a carrier solution.

The floating polishing head generally provides a controllable pressure on the wafer backside to push the wafer against the polishing pad. As mentioned, some polishing heads include a flexible membrane that provides a mounting surface for the wafer, and a retaining ring to hold the wafer beneath the mounting surface. The retaining ring may be made of various hard polymer materials and is mounted on a base of the polishing head. Pressurization or evacuation of a chamber behind the flexible membrane controls the load on the wafer.

A problem encountered in CMP is the difficulty of removing the wafer from the polishing pad surface once polishing has been completed. When the wafer is placed in contact with the polishing pad with a layer of slurry on its surface, the surface tension of the slurry generates an adhesive force that binds the wafer to the polishing pad. Typically, the wafer is vacuum-chucked to the underside of the polishing head, and the polishing head is used to remove the wafer from the polishing pad. When the polishing head is retracted from the polishing pad, the wafer is lifted off the pad. However, if the surface tension holding the wafer on the polishing pad is greater than the vacuum-chucked force holding the wafer on the polishing head, then the wafer will remain on the polishing pad when the polishing head retracts. This may cause the wafer to fracture.

To solve the above-mentioned problem, a downwardly-projecting lip structure (also referred to as a "knife-edge") fixed along the outer edge of a disk-shaped supporting plate is typically provided in some polishing head design. One such case is, for example, Titan Head™, which is designed for Applied Materials" Mirra CMP system. However, the prior art fixed lip structure leads to another recurring problem in CMP, which is the so-called "edge effect" or "fast-band effect", i.e., the tendency of the wafer perimeter to be polished at a faster rate than the wafer center, which results in poor intra-wafer uniformity. The fixed knife-edge structure helps to lift the wafer when the wafer polishing is completed, but planarity and uniformity suffers since the downwardly-projecting fixed knife-edge provides a larger downward force along the perimeter of the wafer than within the center region during the wafer polishing stage.

SUMMARY OF INVENTION

In one aspect, the invention is directed to a polishing head for a chemical mechanical polishing system. The polishing head includes a base, a retaining ring secured to the base defining a pocket area beneath the base, and a lower assembly floating within the pocket area by way of a diaphragm seal. The lower assembly includes a disk-shaped support plate having a plurality of apertures distributed in a center region of the support plate, a clamp ring used to secure the diaphragm seal along a rim region of the support plate, and a floating knife-edge mechanism positioned between the rim region and the center region of the support plate.

The support plate presents a substantially flat bottom surface for pressing a backside of a wafer, and provides a uniform downward force across the backside of the wafer during a CMP operation. When wafer polishing is completed, the floating knife-edge mechanism provides a downwardly-projecting lip portion to engage with the wafer so as to form a seal for improved vacuum-chucking. In another aspect, the present invention is directed to a lower assembly of a polishing head for CMP applications. The lower assembly comprises a support plate having a plurality of apertures distributed in a center region of the support plate, a clamp ring used to secure a diaphragm seal along a rim region of the support plate, and a floating knife-edge mechanism embedded in the support plate between the rim region and the center region. The floating knife-edge mechanism provides a substantially flat support plate bottom surface for pressing a backside of a wafer, and a uniform downward force across the backside of the wafer during a CMP operation.

According to one preferred embodiment of the present invention, the floating knife-edge mechanism comprises a discontinuous upper portion and a continuous annular lower portion. The discontinuous upper portion of the floating knife-edge mechanism is pushed downwardly by an independent bladder to engage with the wafer when a CMP operation is completed.

Advantages of the invention include reliable removal of a wafer from a polishing pad, minimal fast-band effects, and improved flatness and uniformity of the wafer.

Other advantages and features of the invention will be apparent from the following description, including the drawings and claims.

DETAILED DESCRIPTION

Figure 1:
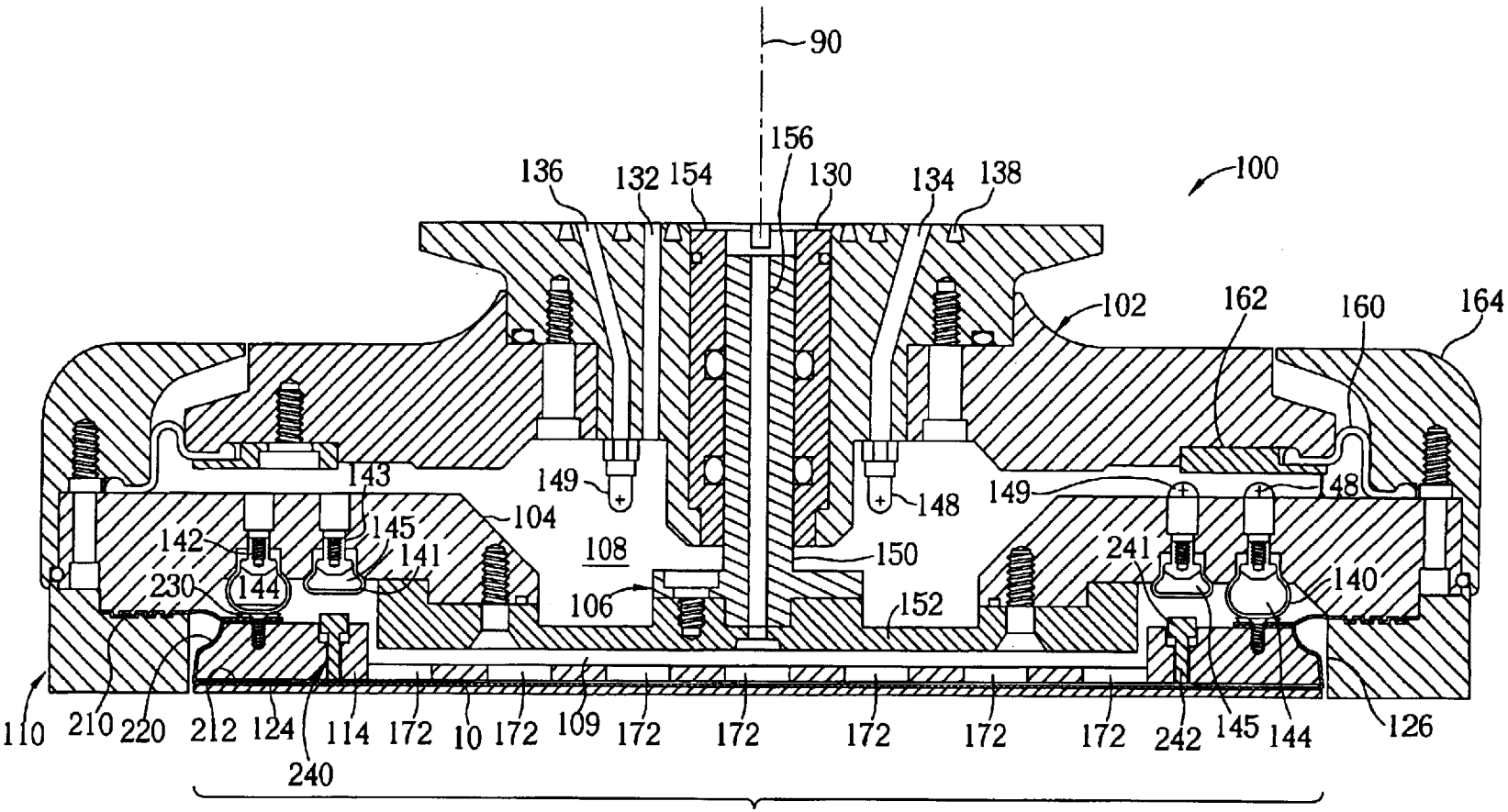
FIG. 1 is a schematic cross-sectional diagram depicting a polishing head having a knife-edge mechanism in a floating state according to the present invention.

Please refer to FIG. 1. FIG. 1 is a schematic, cross-sectional diagram depicting a polishing head 100 with a knife-edge mechanism 240 in a floating state according to the present invention. As shown in FIG. 1, the polishing head 100 generally includes a housing 102, a base 104, a gimbal mechanism 106, a loading chamber 108, a retaining ring 110, and a lower assembly 112. A description of a similar polishing head may be found in U.S. Pat. No. 6,244,942, which is incorporated herein by reference.

Housing 102 can be connected to a drive shaft (not shown) to rotate therewith during polishing about an axis of rotation 90, which is substantially perpendicular to the surface of a polishing pad (not shown) during polishing. Housing 102 may be generally circular in shape to correspond to the circular configuration of the wafer to be polished. A vertical bore 130 may be formed through the housing 102. Three passages 132, 134 and 136 may extend through the housing 102 for pneumatic control of the polishing head 100. O-ring 138 is then used to form air-tight seals between the passages through the housing 102 and passages through the drive shaft.

Base 104 is a generally rigid ring-shaped or disk-shaped body located beneath housing 102. Two elastic and flexible membranes 140 and 141 are attached to the lower surface of base 104 by clamp rings 142 and 143, respectively, to define a bladder 144 and a bladder 145. Clamp rings 142 and 143 may be secured to base 104 by screws or bolts. A passage may extend through each of the clamp rings 142 and 143 and the base 104. Fixtures 148 and 149 may provide attachment points to connect flexible tubes between housing 102 and base 104 to fluidly couple passages 134 and 136, respectively, to bladders 144 and 145. A first pump (not shown) may be connected to passage 134 to cause air to flow into or out of the bladder 144. A second pump (not shown) may be connected to passage 136 to cause air to flow into or out of the bladder 145. In another preferred embodiment according to the present invention, an actuatable valve may be positioned across a passage connected to the bladder 140 to sense the presence of a wafer.

Loading chamber 108 is located between housing 102 and base 104 to apply a load, i.e., a downward pressure, to the base 104. The vertical position of the base 104 relative to a polishing pad is also controlled by the loading chamber 108. Gimbal mechanism 106, which may be considered to be part of the base 104, permits the base 104 to pivot with respect to the housing 102 so that the base 104 may remain substantially parallel with the surface of the polishing pad. Gimbal mechanism 106 includes a gimbal rod 150, which fits into vertical bore 130, and a flexure ring 152, which is secured to the base 104. Gimbal rod 150 is capable of sliding vertically in bushing 154 to provide vertical motion for base 104, but prevents any lateral motion of the base 104 with respect to the housing 102. Gimbal rod 150 may include a passage 156 that extends the length of the gimbal rod 150.

An inner edge of a generally ring-shaped rolling diaphragm 160 may be clamped to housing 102 by an inner clamp ring 162, and an outer clamp ring 164 may clamp an outer edge of the rolling diaphragm 160 to the base 104. In this way, the rolling diaphragm 160 seals the space between the housing 102 and the base 104 to define the loading chamber 108. A third pump (not shown) may be fluidly connected to the loading chamber 108 by passage 132 to control the pressure in the loading chamber 108 and hence the load applied to the base 104.

Retaining ring 110 may be a generally annular ring secured along the outer edge of the base 104. When fluid is pumped into the loading chamber 108 and the base 104 is thus pushed downwardly, retaining ring 110 is also pushed downwardly to apply a load to the polishing pad (not shown). The retaining ring 110, secured to the base 104, defines a pocket area for accommodating a wafer 10 beneath the base 104. An inner surface 126 of the retaining ring 110 engages the wafer 10 to prevent the wafer 10 from escaping from beneath the polishing head 100.

The lower assembly 112 generally includes a support plate 114, a diaphragm seal 210, a wafer membrane 220, a clamp ring 230, and an insert film 212. The sealed volume between the insert film 212, the support plate 114, the flexure diaphragm seal 210, the base 104, and the gimbal mechanism 106 defines a pressurizable chamber 109. A fourth pump (not shown) may be fluidly connected to the chamber 109 to control the pressure in the chamber and thus the downward force of the wafer membrane 220 on the wafer 10.

The support plate 114 has a plurality of apertures 172 evenly distributed in a center region of the support plate 114. The diaphragm seal 210 is generally an annular ring of a flexible material. An outer edge of the diaphragm seal 210 is clamped between the base 104 and the retaining ring 110, and the inner edge of the diaphragm seal 210 is clamped between the clamp ring 230 and the support plate 114. The diaphragm seal 210 may be formed of rubber, such as neoprene, an elastomeric-coated fabric, such as NYLON™ or NOMEX™, plastic, or a composite material, such as fiberglass. The wafer membrane 220 may be a cushioning polymer film attached to the support plate 114 with a pressure sensitive adhesive, which cushions the wafer 10 during the polishing and compensates for slight flatness variations in the wafer 10 or support plate 114. The rim of the wafer membrane 220 is secured to the support plate 114 beneath the inner edge of the diaphragm seal 210 along the rim region of the support plate by the clamp ring 230.

The insert film 212, which is interposed between the support plate 114 and the wafer membrane 220, may be a generally dish-shaped flexible polymer film with a plurality of apertures corresponding to the apertures 172 of the support plate 114.

An annular floating knife-edge mechanism 240 is embedded in the support plate 114 between the rim region and the center region of the support plate 114. The floating knife-edge mechanism 240, which includes a discontinuous upper portion 241 and a continuous lower portion 242, provides a substantially flat support plate bottom surface 124 for pressing a backside of the wafer 10, and applies a uniform downward force across the backside of the wafer 10 during polishing.

Figure 2:
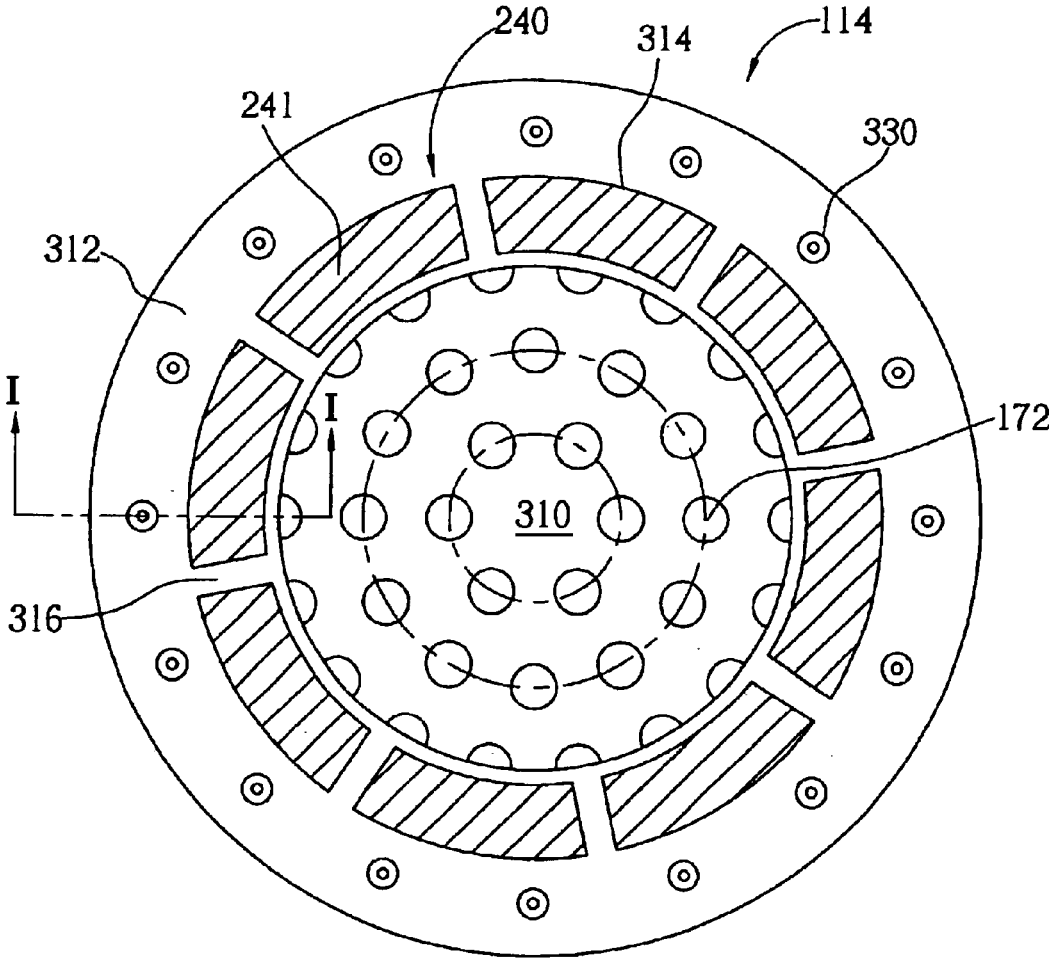
FIG. 2 is a top view of a support plate of a lower assembly depicting a discontinuous upper portion of a floating knife-edge mechanism according to the present invention.

Please refer to FIG. 1 and FIG. 2. FIG. 2 is a top view of the support plate 114 depicting the position of the floating knife-edge mechanism 240. For simplicity, the remaining parts (clamp ring, wafer membrane, etc.) of the lower assembly 112 are omitted and the elements in FIG. 2 are not drawn in proportion to the corresponding elements shown in FIG. 1. In FIG. 2, the support plate 114 includes a center region 310 and a rim region 312. As mentioned, a plurality of apertures 172 are formed in the center region 312. Screw holes 330 are distributed in the rim region 312 for securing the diaphragm seal 210 and the wafer membrane 220 by the clamp ring 230. The discontinuous upper portions 241 of the floating knife-edge mechanism 240 are embedded in a belt region between the center region 310 and the rim region 312. More specifically, each discontinuous upper portion 241 is accommodated in a trench 314 formed in the support plate 114 with a connection portion 316 formed between two adjacent trenches 314 so that the center region 310 and the rim region 312 are connected.

Figure 3A:
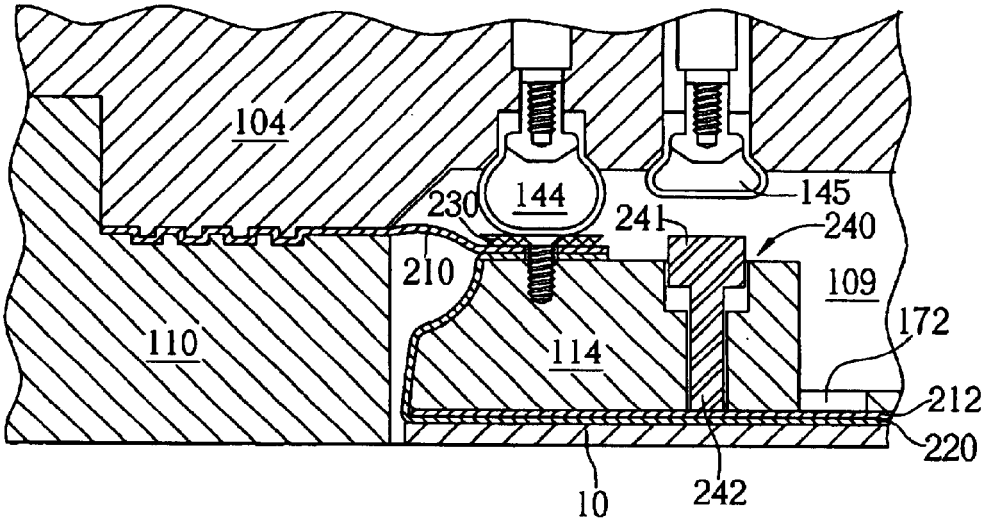
FIG. 3A is an enlarged cross-sectional view of a polishing head through line I–I of FIG. 2 showing a floating knife-edge mechanism during polishing.
Figure 3B:
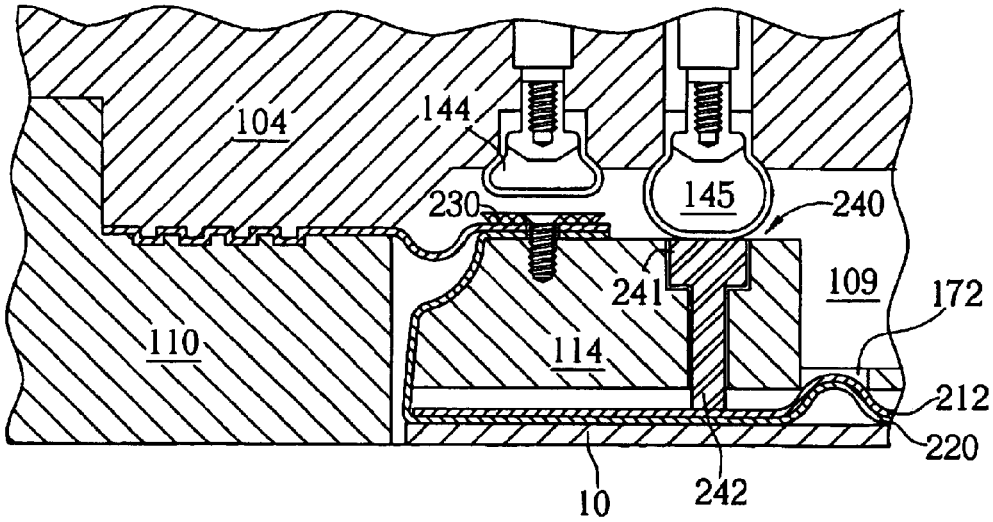
FIG. 3B is an enlarged cross-sectional view of a polishing head through line I–I of FIG. 2 showing a floating knife-edge mechanism in a vacuum-chucking state.

Please refer to FIG. 3A and FIG. 3B. FIG. 3A is an enlarged cross-sectional view of the polishing head through line AA" in FIG. 2 showing the floating knife-edge mechanism 240 during polishing, and FIG. 3B is an enlarged cross-sectional view of the polishing head through line AA" in FIG. 2 showing the floating knife-edge mechanism 240 in a vacuum-chucking state.

As shown in FIG. 3A, when polishing, the support plate 114 is pressed by the inflated bladder (or rim bladder) 144 while the floating knife-edge mechanism 240 floats. Meanwhile, the chamber 109 is pressurized. In one implementation, the bladder 145 may be pressurized to a pressure that is less than the pressure in the bladder 144. As previously discussed, one recurring problem in CMP is the so-called fast-band effect. Floating knife-edge mechanism 240 may be used to reduce or minimize the fast-band effect by providing a substantially flat bottom surface of the support plate 114 across the backside of the wafer 10 during polishing.

As shown in FIG. 3B, when polishing is completed, fluid is pumped out of the chamber 109 to vacuum chuck the wafer to the wafer membrane 220. The upper portion 241 of the floating knife-edge mechanism 240 is pushed by the inflated bladder 145 to downwardly extend the lower portion 242. The extended lower portion 242 engages with the wafer 10 so as to form a seal that improves vacuum-chucking. Preferably, the lip portion 242 extends downwardly from the bottom surface of the plate by 1 mm to 2 mm. The loading chamber 108 is then evacuated to lift the base 104 and the support plate 114 off the polishing pad.

Those skilled in the art will readily observe that numerous modification and alterations of the device may be made while retaining the teachings of the invention. Accordingly, the above disclosure should be construed as limited only by the metes and bounds of the appended claims.

What is claimed is:

1. An improvement CMP polishing head having a base, a retaining ring secured to the base defining a pocket area beneath the base, and a lower assembly floating within the pocket area by way of a diaphragm seal, the lower assembly having a disk-shaped plate having a plurality of apertures distributed in a center region of the plate, a clamp ring used to secure the diaphragm seal along a rim region of the plate, and a floating knife-edge mechanism, characterized in that:

the floating knife-edge mechanism disposed through an opening between the rim region and the center region of the plate, the floating knife-edge mechanism including an independently movable member relative to the plate movable between a first retracted position wherein the plate presents a substantially flat bottom surface during a CMP operation, and a second extended position providing a downwardly projected lip portion engaging the wafer so as to form a seal for improved vacuum-chucking.

2. The polishing head according to claim 1 wherein the floating knife-edge mechanism is controlled by a first bladder and an independent pump system thereof.

3. The polishing head according to claim 1 wherein the lip portion extends 1 mm to 2 mm downwardly from the bottom surface of the plate.

4. The polishing head according to claim 1 wherein the lower assembly further comprises a wafer membrane, and an insert film positioned between the wafer and the bottom surface of the plate.

5. The polishing head according to claim 4 wherein the wafer membrane is secured to the plate by the clamp ring along the rim region of the plate.

6. The polishing head according to claim 1 wherein pressure applied on the rim region of the plate is adjusted by a second bladder.

7. A lower assembly of a CMP polishing head having a support plate with a plurality of apertures distributed in a center region of the support plate; a clamp ring used to secure a diaphragm seal along a rim region of the support plate; and a floating knife-edge mechanism embedded in the support plate between the rim region and the center region, characterized in that:

the floating knife-edge mechanism disposed through an opening between the rim region and the center region of the plate, the floating knife-edge mechanism including an independently movable member relative to the plate movable between a first retracted position wherein the plate presents a substantially flat bottom surface during a CMP operation, and a second extended position providing a downwardly projected lip portion engaging the wafer so as to form a seal for improved vacuum-chucking.

8. The lower assembly according to claim 7 wherein the floating knife-edge mechanism comprise, a discontinuous upper portion and a continuous ring-shaped lower portion.

9. The CMP polishing head according to claim 7 further comprising:

a base; and a retaining ring secured to the base defining a pocket area beneath the base;

wherein the lower assembly floats within the pocket area by way of a diaphragm seal.

10. The lower assembly according to claim 7 wherein the floating knife-edge mechanism is controlled by a first bladder and an independent pump system thereof.

11. The lower assembly according to claim 7 wherein pressure applied on the rim region of the support plate is adjusted by a second bladder.

* * * * *

UNITED STATES PATENT AND TRADEMARK OFFICE

CERTIFICATE OF CORRECTION

PATENT NO. : 6,755,726 B2
DATED : June 29, 2004
INVENTOR(S) : Chen et al.

It is certified that error appears in the above-identified patent and that said Letters Patent is hereby corrected as shown below:

Title page,
Item [*] Notice, should read -- Subject to any disclaimer,the term of this patent is extended or adjusted under 35 US.C. 154(B) by 73 days. --

Signed and Sealed this

Twenty-eighth Day of September, 2004

JON W. DUDAS
*Director of the United States Patent and Trademark Office*

UNITED STATES PATENT AND TRADEMARK OFFICE

CERTIFICATE OF CORRECTION

PATENT NO. : 6,755,726 B2
DATED : June 29, 2004
INVENTOR(S) : Tzu-Shin Chen et al.

It is certified that error appears in the above-identified patent and that said Letters Patent is hereby corrected as shown below:

Title page,
Item [75], Inventors, second inventor address should be changed from "Yang-Kang" to -- Tai-Nan Hsien --.
Item [73], Assignee, should read -- United Microelectronics Corp. --
Item [*] Notice, should read -- Subject to any disclaimer,the term of this patent is extended or adjusted under 35 US.C. 154(b) by 0 days. -- (as deleted by Certificate of Correction issued September 28, 2004) should be reinstated.

This certificate supersedes Certificate of Correction issued September 28, 2004.

Signed and Sealed this

Twenty-eighth Day of December, 2004

JON W. DUDAS
*Director of the United States Patent and Trademark Office*